US008989397B2

(12) United States Patent
Lee

(10) Patent No.: US 8,989,397 B2
(45) Date of Patent: Mar. 24, 2015

(54) SYSTEM AND METHOD FOR HIGH RELIABILITY SOUND PRODUCTION

(71) Applicant: Kyounghee Lee, San Ramon, CA (US)

(72) Inventor: Kyounghee Lee, San Ramon, CA (US)

( * ) Notice: Subject to any disclaimer, the term of this patent is extended or adjusted under 35 U.S.C. 154(b) by 313 days.

(21) Appl. No.: 13/740,491

(22) Filed: Jan. 14, 2013

(65) Prior Publication Data

US 2014/0198920 A1 Jul. 17, 2014

(51) Int. Cl.

| | |
|---|---|
| ***H04R 29/00*** | (2006.01) |
| ***H04R 9/06*** | (2006.01) |
| ***G08B 29/00*** | (2006.01) |
| ***G08B 29/06*** | (2006.01) |

(52) U.S. Cl.

CPC ..... *H04R 29/003* (2013.01); *G08B 29/06* (2013.01); *H04R 9/063* (2013.01)

USPC ..... 381/59; 381/401; 381/409; 340/508

(58) Field of Classification Search

CPC .. H04R 29/001; H04R 29/002; H04R 29/003; H04R 9/046; H04R 9/063; G08B 29/06

USPC ..... 381/55, 58, 59, 335, 91, 96, 117, 123, 381/401, 407, 409; 340/507, 508

See application file for complete search history.

(56) References Cited

U.S. PATENT DOCUMENTS

| | | | | |
|---|---|---|---|---|
| 3,855,415 | A * | 12/1974 | Fox et al. | 381/59 |
| 3,989,908 | A * | 11/1976 | Budrys et al. | 381/59 |
| 4,037,222 | A * | 7/1977 | Solomon | 381/150 |
| 4,100,380 | A * | 7/1978 | Gosswiller | 381/59 |
| 5,652,566 | A * | 7/1997 | Lambert | 381/59 |
| 7,292,141 | B2 * | 11/2007 | Staats et al. | 600/300 |
| 7,962,188 | B2 * | 6/2011 | Kiani et al. | 600/310 |
| 2002/0071568 | A1 * | 6/2002 | Shuttleworth | 381/59 |
| 2005/0031151 | A1 * | 2/2005 | Melillo | 381/407 |
| 2006/0251265 | A1 * | 11/2006 | Asada | 381/58 |
| 2009/0028349 | A1 * | 1/2009 | Park | 381/59 |
| 2009/0295591 | A1 * | 12/2009 | Bedingfield | 340/660 |
| 2011/0043366 | A1 * | 2/2011 | Osone et al. | 340/573.1 |
| 2013/0070933 | A1 * | 3/2013 | Itou | 381/59 |

FOREIGN PATENT DOCUMENTS

| | | | |
|---|---|---|---|
| JP | 08084393 | A * | 3/1996 |
| JP | 2005202624 | A * | 7/2005 |
| JP | 2007037024 | A * | 2/2007 |
| JP | 2010089666 | A * | 4/2010 |
| JP | 2012199854 | A * | 10/2012 |

* cited by examiner

*Primary Examiner* — John Villecco

(57) ABSTRACT

A system and method are provided for creating a loudspeaker system with low failure rate of sound production. The system uses a loudspeaker with more than one voice coil, a circuit to detect breakage of a voice coil and a switching circuit to steer the system input signal to a remaining good voice coil.

13 Claims, 10 Drawing Sheets

SYSTEM AND METHOD FOR HIGH RELIABILITY SOUND PRODUCTION

FIELD OF THE INVENTION

Embodiments relate to loudspeakers and in particular to a loudspeaker system and method for reproducing sound with a low failure rate.

BACKGROUND

Loudspeakers change an electrical signal into sound. Prior Art FIG. 1 shows a cross-sectional view of the main components of a moving-coil type loudspeaker 100. A rigid metal frame 101 attaches to a magnet 102, which subjects the air gap 108 between the magnet and the frame to a strong magnetic field. A lightweight diaphragm 103 attaches to the frame 101 and to the cylindrical shaped bobbin 107. A voice coil 104 is wound around the bobbin 107. The voice coil attaches through two voice coil wires 105 to two contacts 106. When a current is run through voice coil 104, the magnetic field in air gap 108 will interact with the current in coil 104 to create a force that causes the bobbin to move up or down depending on the direction of the electrical current. This in turn moves the diaphragm, which produces air pressure waves that result in sound.

Loudspeakers are electromechanical devices subject to failures. Some failure conditions may result in no sound at all being produced. In certain applications, it is critical that a sound is produced, even if distorted, such as is the case in medical devices, such as patient monitors. For this and other applications, a loudspeaker should have low failure rate of sound production.

Failure mechanisms of loudspeakers include voice coil wire breakage, damage of the diaphragm, diaphragm separating from the frame, and other mechanical failures. Although many of these failure mechanisms result in distorted sound, damage to the voice coil leads to no sound at all, which is undesirable in alarm sound applications.

Voice coil breakage results from mechanical stress. The voice coil moves with the diaphragm, but the wires of the voice coil attach to stationary contacts typically mounted on the loudspeaker frame. Hence the wires move and change shape with every diaphragm movement, or with every sound made by the loudspeaker.

Numerous technologies may reduce the chance of voice coil wire breakage. For example, the wires may be given extra length for strain-relief; they may be pre-shaped to allow movement, etc. The loudspeaker may also be designed such that the wires move in free space, away from other surfaces that may cause friction damage.

Despite such technologies, the voice coil wires have some probability of breaking, because they are subject to constant mechanical deformation and stress. If they break, the resulting total absence of sound is problematic in alarm applications. There is, therefore, a need for addressing these and other issues associated with the prior art.

SUMMARY

A system and method are provided where a loudspeaker includes two or more voice coils. The system is configured such that the system provides a warning when one or more voice coil wires are broken, but continues to produce sound using one or more of the remaining voice coils. Assuming that the warning is observed, and timely repair or replacement of the loudspeaker is performed, the probability of complete failure and the loudspeaker being unable to generate sound is reduced to a minimum.

BRIEF DESCRIPTION OF THE DRAWINGS

Prior Art

DETAILED DESCRIPTION

Figure 1:
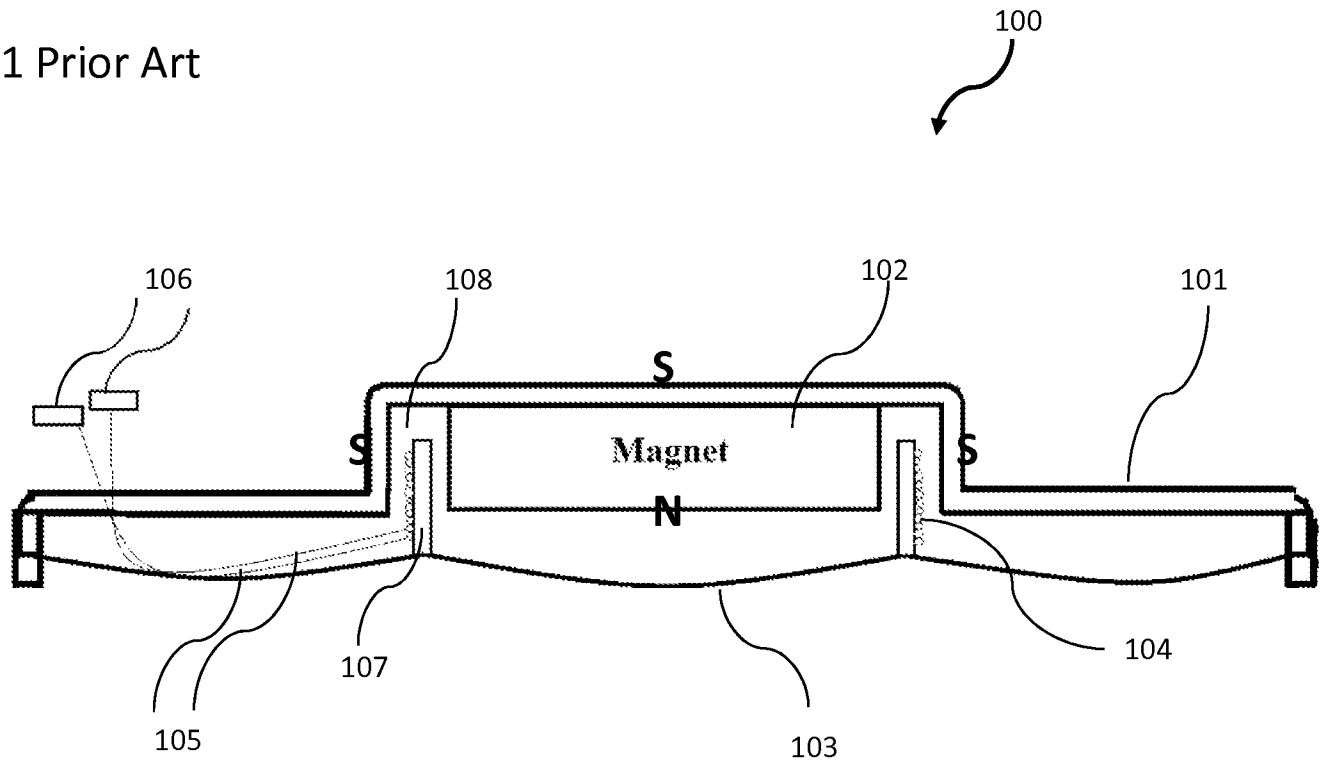
Figure 1 Prior Art
FIG. 1 shows the construction of a loudspeaker with its main components
Figure 2:
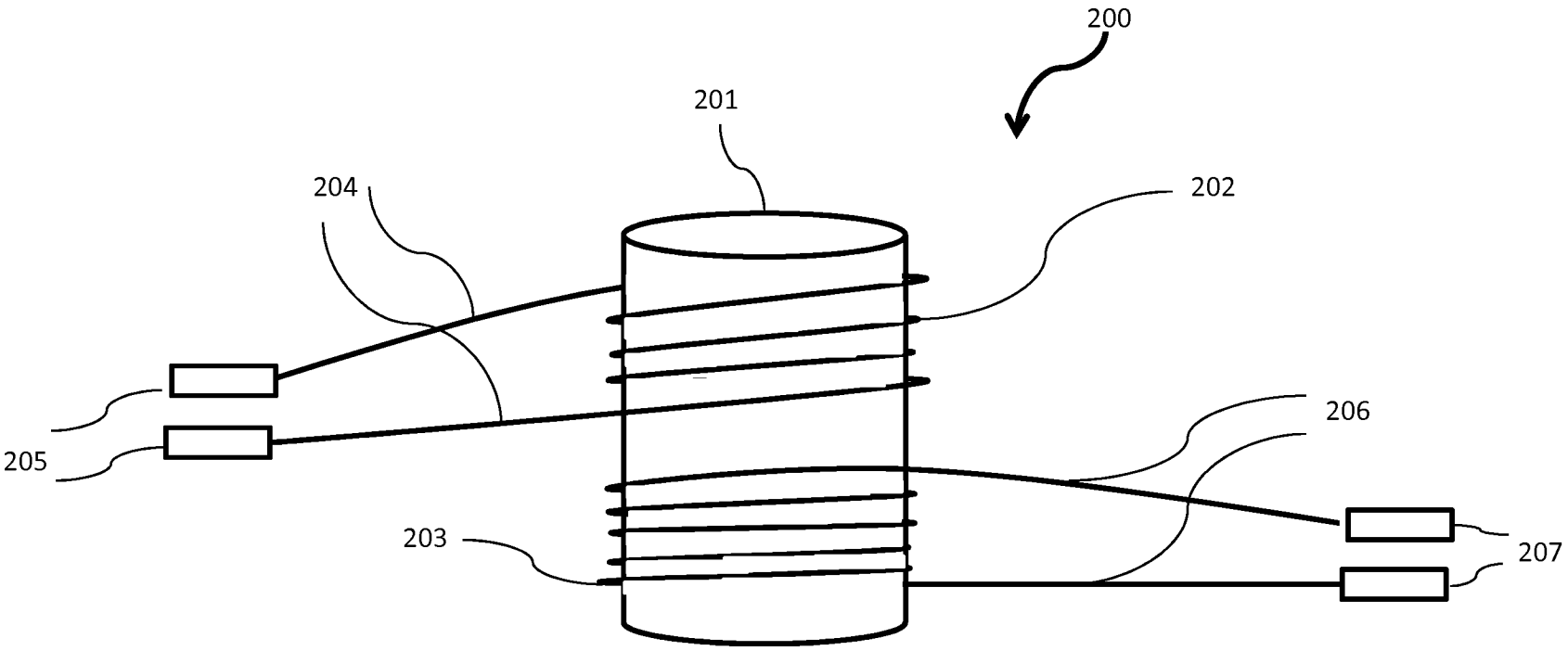
FIG. 2 shows the bobbin and coils of a loudspeaker, in accordance with one embodiment.

FIG. 2 shows a diagram of one embodiment. The bobbin 201 may comprise two coils wound thereon. Voice coil 202 with voice coil wires 204 and contacts 205 constitute the coil used for initial operation. Voice coil 203 with voice coil wires 206 and contacts 207 constitute another coil that can be used if voice coil 202 or its voice coil wires 204 break. The mechanism by which the two coils are driven and the way that coil break is determined will be described below.

The two coils may be adjacent to each other as shown in FIG. 2, or the coils may be wound on top of each other or in other configurations. The coils may be wound in the same direction, or in opposite directions. There may be two coils, or more than two coils may be used to further reduce failure rate.

The coils may have completely separate contacts, as shown in FIG. 2, or the coils may use a common contact, for example a common 'ground' contact. The coils may also share both contacts as will be described with reference to FIG. 10 below.

Figure 3:
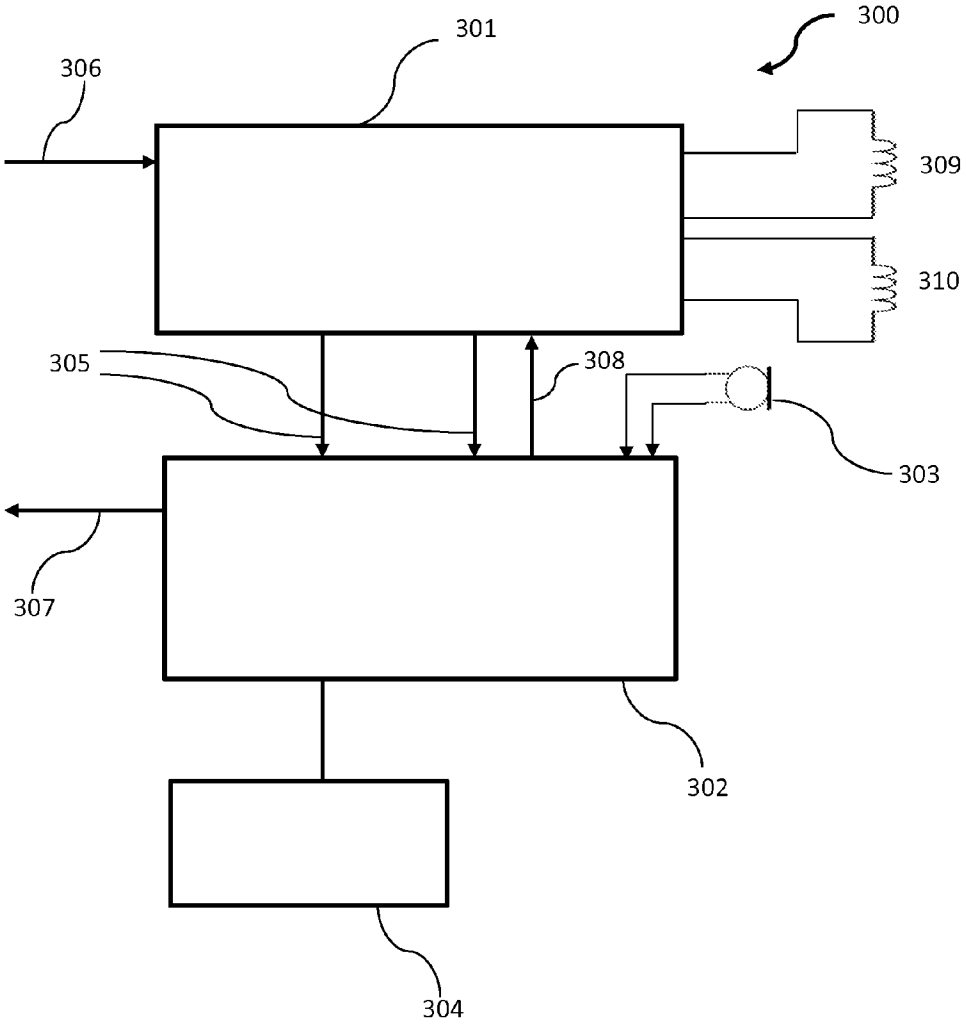
FIG. 3 shows a high reliability sound production system in accordance with one embodiment.

FIG. 3 shows one embodiment of a high reliability loudspeaker system according to one embodiment. The coils 202 and coils 203 from FIG. 2 are now shown as coil 309 and coil 310 in FIG. 3. The coil drive mechanism 301 may be configured to drive either coil 309 or coil 310, with an audio input signal 306 received from the outside environment. The outside environment may be, for example, a patient heart monitor, another medical instrument or any electronic device in need of a high reliability loudspeaker system. The failure detection mechanism 302 detects failure of coil 309 or coil 310 by using signals 305 from the coil drive mechanism and optionally using a microphone 303 placed close to the speaker. An optional memory 304 allows the failure detection mechanism 302 to persistently remember coil failure across loss of system power. The failure detection mechanism may be configured to inform the environment of a coil failure through signal 307. The signal 307 may be carried over a bus such as the I2C Inter IC bus, SPI Serial Peripheral Interface bus, another type bus, or one or more logic signals that indicate the status of the loudspeaker system, or any other notification mechanism.

The system of FIG. 3 may be configured to operate as follows. Initially, the drive electronics 301 drives coil 309. The failure detection mechanism may be configured to observe the status of coil 309 and coil 310. This failure detection may involve voltage and or current data 305 obtained from the coil drive mechanism. Optionally, the failure detection mechanism may comprise microphone 303 to check for actual sound present condition. The failure detection may be carried out once at each system power on, by running power on test(s), or the detection may be configured to occur continuously while the system is in normal operation. Alternately, the system may periodically interrupt normal operation briefly to test coil 309 and coil 310. Once a failure of coil 309 or 310 is detected, the failure detection mechanism 302 may instruct the coil drive mechanism 301 through connection 308 to drive the remaining good coil. At the same time, the failure detection mechanism may inform the outside environment that one of the coils has failed using connection 307. According to one embodiment, the failure detection mechanism may store the identity of the failed coil failed in memory 304, so that the next time the system is powered on the remaining good coil will be used right away without delay to test first.

The environment, for example the heart rate monitor or other instrument, may be configured to use failure notification 307 to alert an operator that maintenance is needed, while the instrument remains operational and usable. According to one embodiment, the alert mechanism may comprise, for example, displaying a special warning message or flashing a warning screen on the LCD display of the instrument or the generation of a warning tone in addition to normal operation sounds, to alert the operator of the condition that requires maintenance. The alert mechanism may comprise rendering a special 'warning' screen that requires the operator to confirm the condition with a special action. For networked instruments, the alert mechanism may comprise a notification of the device manufacturer, of a service department or of a hospital administration system, for example.

Figure 4:
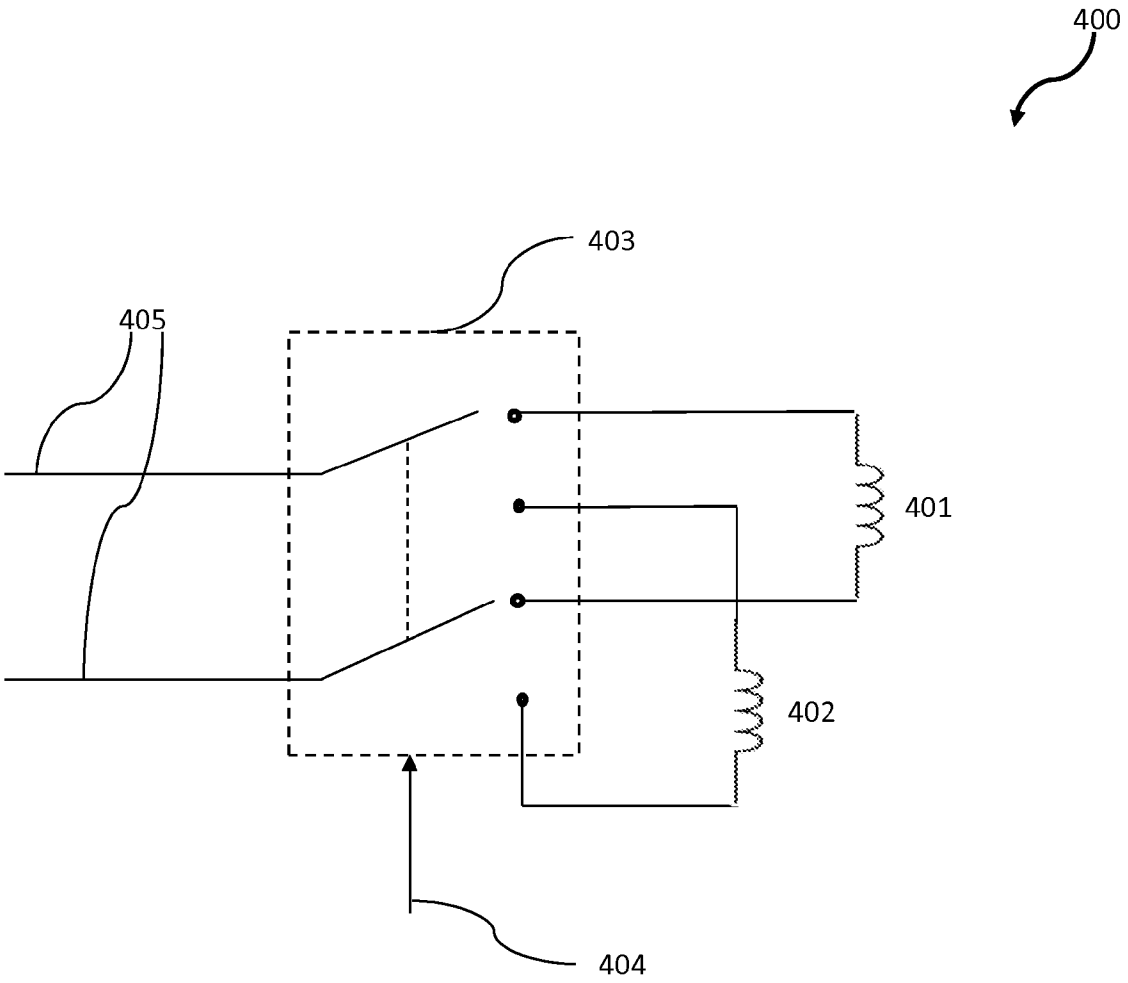
FIG. 4 shows a coil drive mechanism in accordance with one embodiment.

FIG. 4 shows one embodiment 400 of the coil drive mechanism of FIG. 3 using switches. In this embodiment, the environment provides a low impedance speaker drive signal 405. This embodiment may be suitable when an existing instrument is upgraded with the new high reliability speaker subsystem. The existing instrument already has its own speaker drive electronics and using the coil drive mechanism of FIG. 4 ensures that the instrument needs minimal modification to accept the new high reliability speaker system. As shown in FIG. 4, the drive signal 405 may be steered to either coil 401 or to coil 402 by the Dual Pole Double Throw (DPDT) switch 403. The settings of switch 403 may be controlled by signal 404, which is derived from the failure detection mechanism. Note that switch 403 may be implemented in many ways. For example, the high reliability switch 403 may be implemented with CMOS switches, such as a Texas Instruments TS3A24157 or similar device available from many vendors. Alternately, switch 403 may be implemented with an electromechanical switch such as a relay or reed switch. Those skilled in the art may appreciate that switches may be used in many configurations, and that there are many modifications, deletions and substitutions possible with respect to the example of FIG. 4. According to further embodiments, the coil drive mechanism of FIG. 4 may also be adapted in case that more than 2 voice coils are used, by adding additional switches or switch positions.

Figure 5:
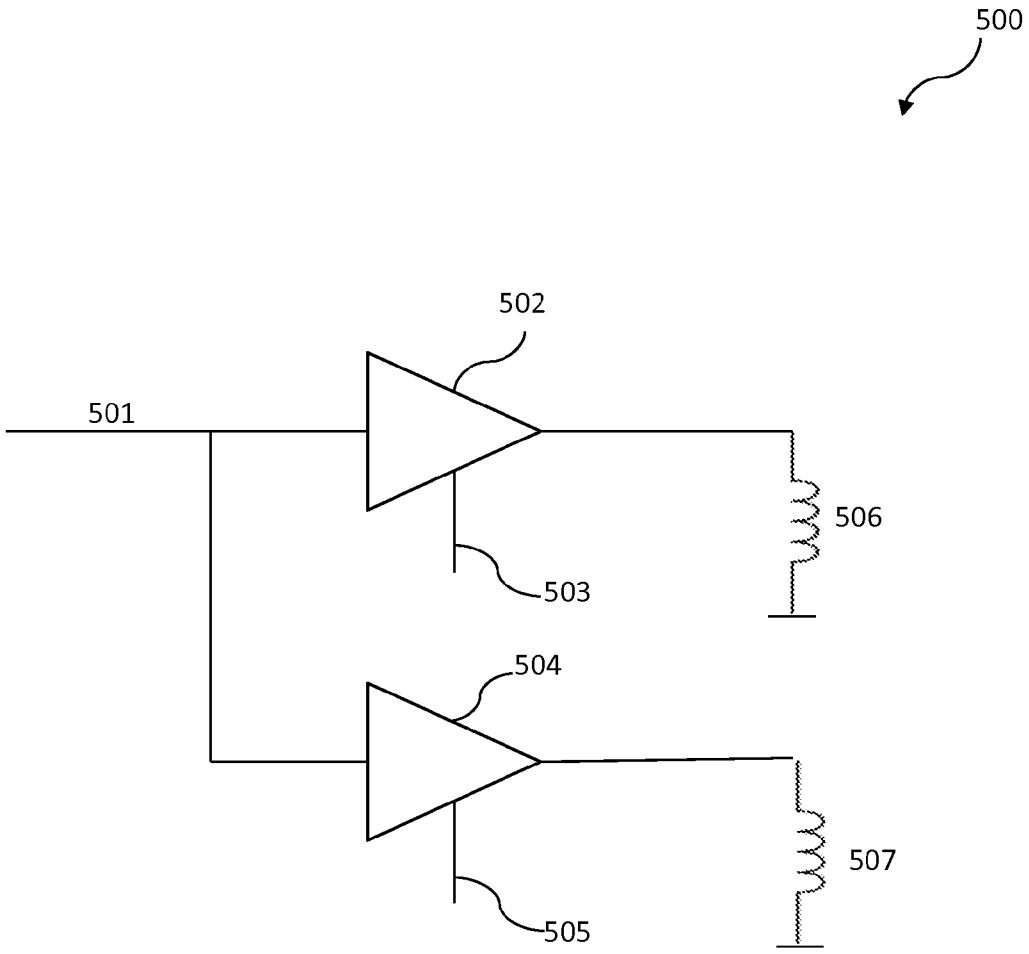
FIG. 5 shows a coil drive mechanism in accordance with one embodiment.

FIG. 5 shows one embodiment 500 of a coil drive mechanism, using two amplifiers. As shown in FIG. 5, the environment may provide a signal input 501. This embodiment is suited for new designs, where the environment need not provide its own speaker driver amplifier. The actual speaker driver amplifiers may be implemented inside the high reliability speaker system by amplifiers 502 and 504. Amplifiers 502 and 504 may be compact high-efficiency class D audio amplifiers with a shutdown provision, such as Maxim MAX9830, On Semi NCP2820 or similar parts available from other vendors. Alternately, any amplifier with the capability to provide low impedance speaker drive and the ability to shut down into a high-impedance output state may be used instead. In initial use, signal 503 enables amplifier 502 to drive coil 506. At the same time, signal 505 disables amplifier 504 and its output remains in high-impedance state so that coil 507 is not loaded and is hence not affecting bobbin movement. Once a coil 506 failure is detected, signal 503 shuts down amplifier 502 and signal 505 enables amplifier 504 so that coil 507 is now driven instead.

Figure 6:
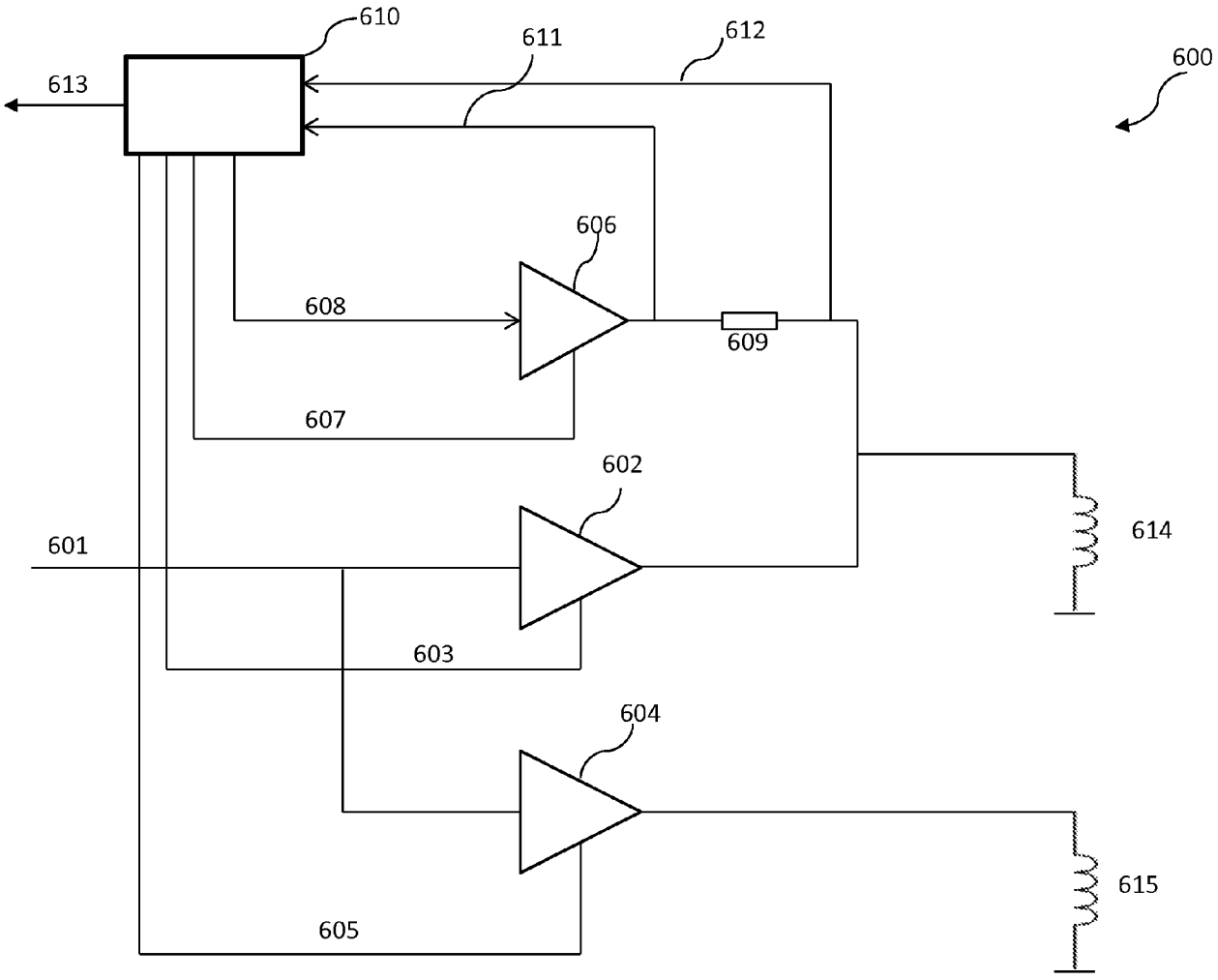
FIG. 6 shows one embodiment of the high reliability sound production system, including amplifiers and a micro-controller as failure detection mechanism, according to one embodiment.

FIG. 6 shows one embodiment of the high reliability speaker system including a failure detection mechanism using a micro-controller (computer or computing device) 610. This embodiment may be configured to use a coil drive mechanism that is similar to that of FIG. 5 but includes a micro controller 610 and one additional amplifier 606 and resistor 609 to test coil 614. The micro controller 610 may be a very low cost micro-controller with a few digital outputs and two or more analog inputs, such as the Texas Instruments MSP430G2001, Freescale MKL04Z8VFK4 or similar micro-controllers available from many vendors. In FIG. 6, the environment provides an input signal 601, and the actual speaker driver amplifiers are 602 and 604. On system power up, or periodically, the micro-controller 610 may disable amplifiers 602 and 604 through shutdown control signals 603 and 605. The micro-controller may then enable amplifier 606 through control signal 607, provide a DC or AC test signal through output 608 and sense current through coil 614 and hence resistor 609 by using the micro-controller internal Analog to Digital (A/D) converters on input signals 611 and 612 taken from both sides of resistor 609. The voltage across resistor 609 may be used to measure the current through coil 614, or alternately, the combination of the voltage on line 611 and the current may be used to measure the impedance of coil 614. A failure of coil 614 may be identified by the current being below a threshold, or by the measured impedance higher than a threshold. The micro-controller may then finish the test, disable amplifier 606 and use the measured current or impedance to determine whether coil 614 is operational (e.g., intact or broken). According to one embodiment, if coil 614 is operational, it enables amplifier 602 through control signal 603. If coil 614 is non-operational, it may send a failure notification to the environment through connection 613, and may enable amplifier 604 through control signal 605 to drive coil 615 instead. According to one embodiment, the circuit of FIG. 6 may be modified to also test coil 615, using one more amplifiers and resistors. Another embodiment enables avoiding use of a third amplifier, by using a switch to connect the input to amplifier 602 or 604 to either the input signal 601 or test signal 608 provided by micro-controller 610.

According to one embodiment, resistor 609 may be omitted and the power supply current of amplifier 606 may be measured to determine whether the coil is broken. This measurement may, for example, be carried out using a small current measurement resistor in the power supply connection of amplifier 606. One embodiment omits the resistor 609 and instead uses a microphone placed close to the speaker to test for coil failure. In this embodiment, the microphone may be connected to an analog input of micro-controller 610. If necessary, a microphone amplifier may be used to bring the signal to the desired level for the micro-controller input. Advantageously, using a microphone instead of a current sensing resistor enables other failure modes to be detected in this manner.

Figure 7:
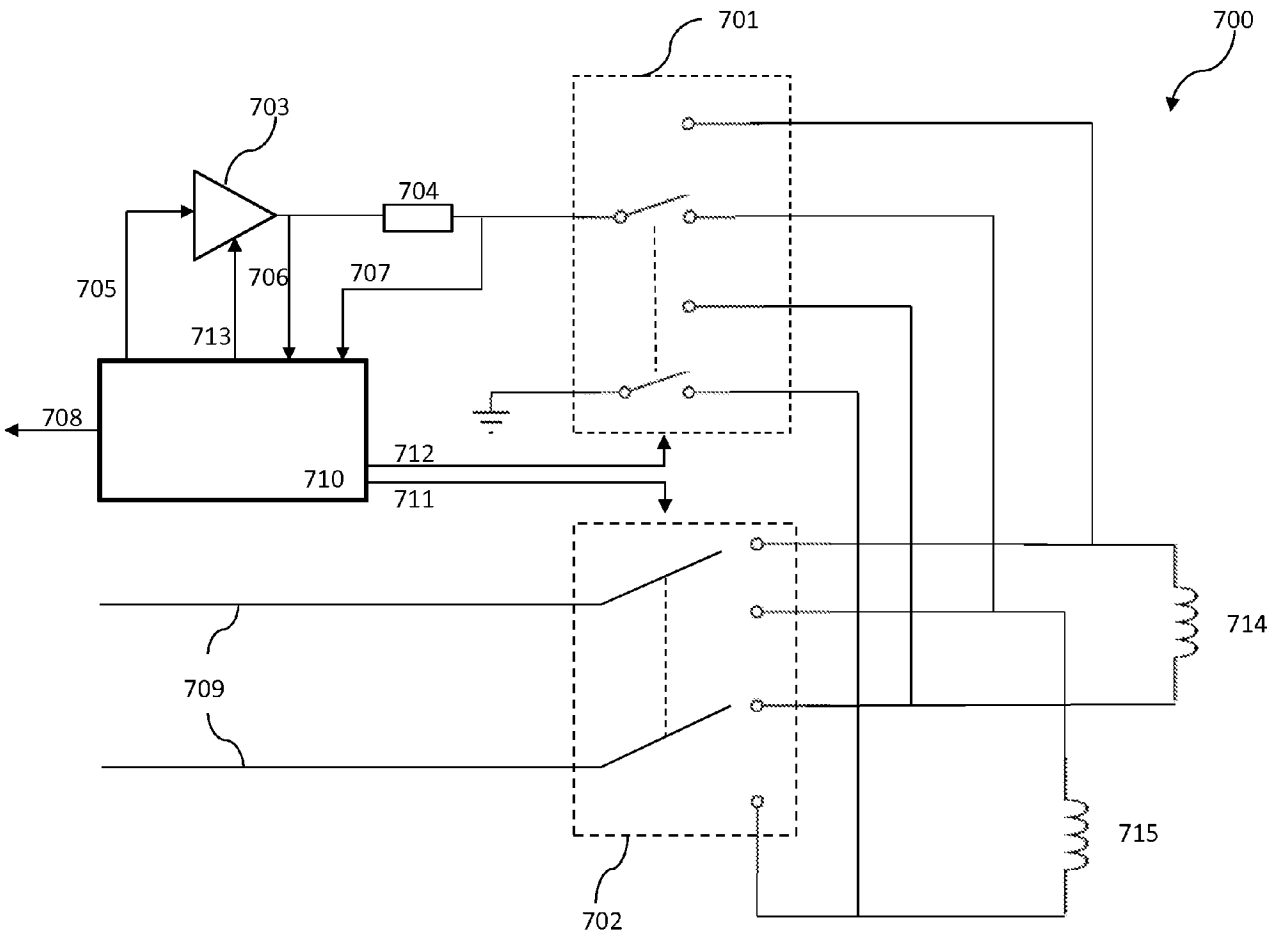
FIG. 7 shows one embodiment of a high reliability sound production system, including switches and a micro-controller as failure detection mechanism, according to one embodiment.

According to one embodiment, the switch based circuit of FIG. 4 may be modified to comprise a failure detection mechanism using a micro-controller. FIG. 7 shows one embodiment of a high reliability speaker system using switches and comprising a failure detection mechanism using a micro-controller 710. The micro-controller may be configured to, upon power up, or periodically, test coil 714 and/or coil 715. For example, the micro-controller 710 may be configured to start by connecting the input signal 709 to coil 715 using signal 711 to control switch 702. While coil 714 is not connected to input 709, the micro-controller may use switch 701 through signal 712 to connect coil 714 to amplifier 703 through resistor 704. The micro-controller may be configured to send a DC or AC test signal using signal 705 and to then observe the current through coil 714 and hence resistor 704 by carrying out A/D conversions on inputs 706 and 707. The micro-controller may then determine whether coil 714 is intact or broken by using the observed current, or the measured impedance of coil 714. If coil 714 is determined to be intact, the micro-controller may use signal 713 to put amplifier 703 in a high-impedance state. The micro-controller may then use signal 711 to connect coil 714 to input signal 709. If coil 714 is broken, the micro-controller may then notify the environment using signal 708, and may use signal 711 to connect input 709 to coil 715 instead. The micro-controller may also be configured to test coil 715 in a similar manner, to thereby allow for more elaborate failure reporting on signal 708 such as, for example, warning that either coil is broken or generating an error message alerting that both coils may be broken. Note that the latter is an extremely unlikely condition, if timely maintenance is performed when one coil is broken.

The high reliability speaker system of FIG. 6 or FIG. 7 may be modified to carry out continuous monitoring of the coil, while the coil is being driven by the environment audio signal. For example, the micro-controller may be configured to observe both the input signal and either a microphone or a coil current sensing resistor. The micro-controller may be further configured to perform tests whenever the input audio signal is active. For example, a medical monitor may emit regular soft beeping sounds that are of sufficient amplitude to perform a coil test with every beep. This method may be preferable over testing at power up, or at periodic interval. This method of testing is configured to detect a failure as it occurs and to switch over to a spare coil without ever interrupting device functionality.

Figure 8:
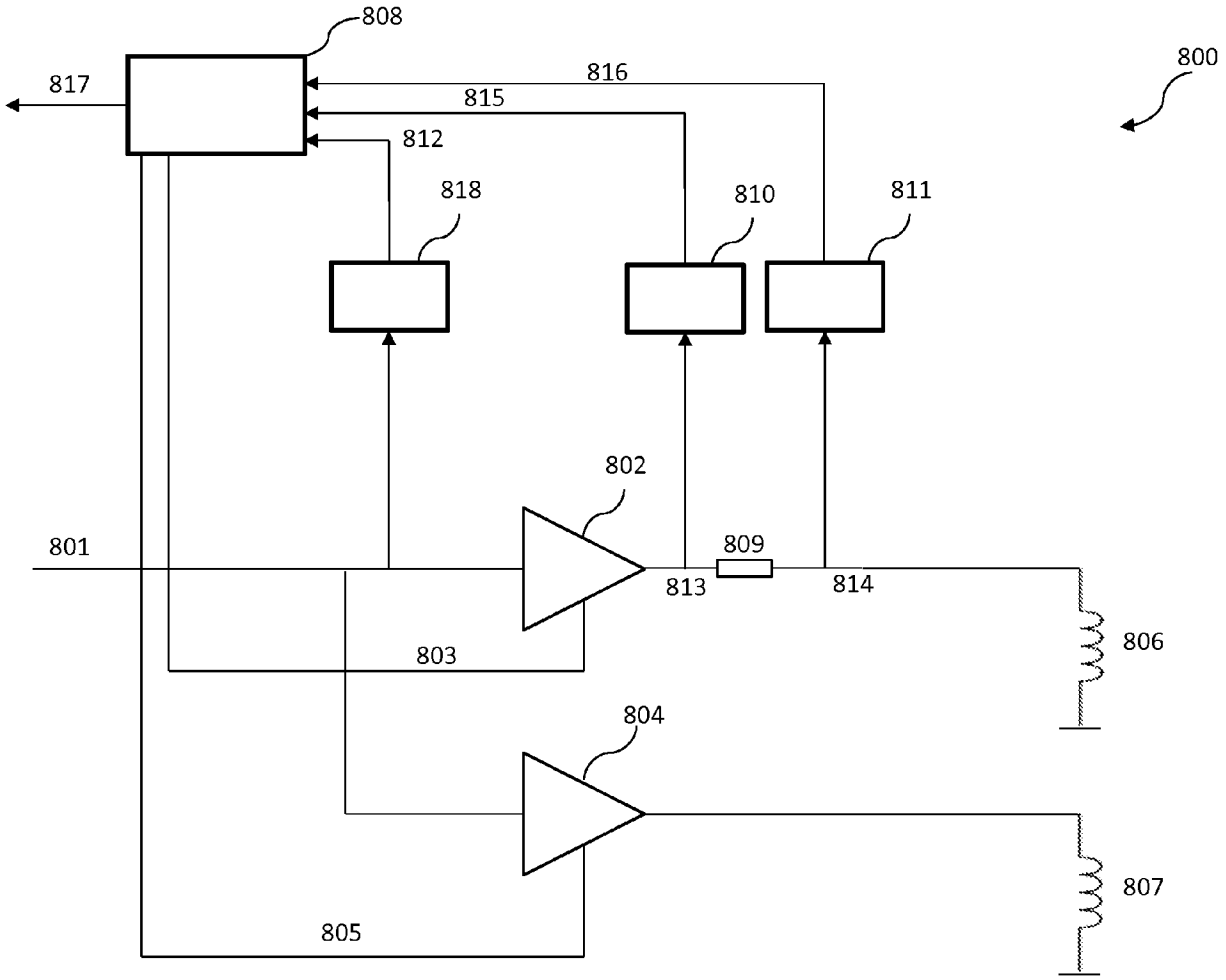
FIG. 8 shows one embodiment of a high reliability sound production system, using two amplifiers and a micro-controller as failure detection mechanism, according to one embodiment.
Figure 9:
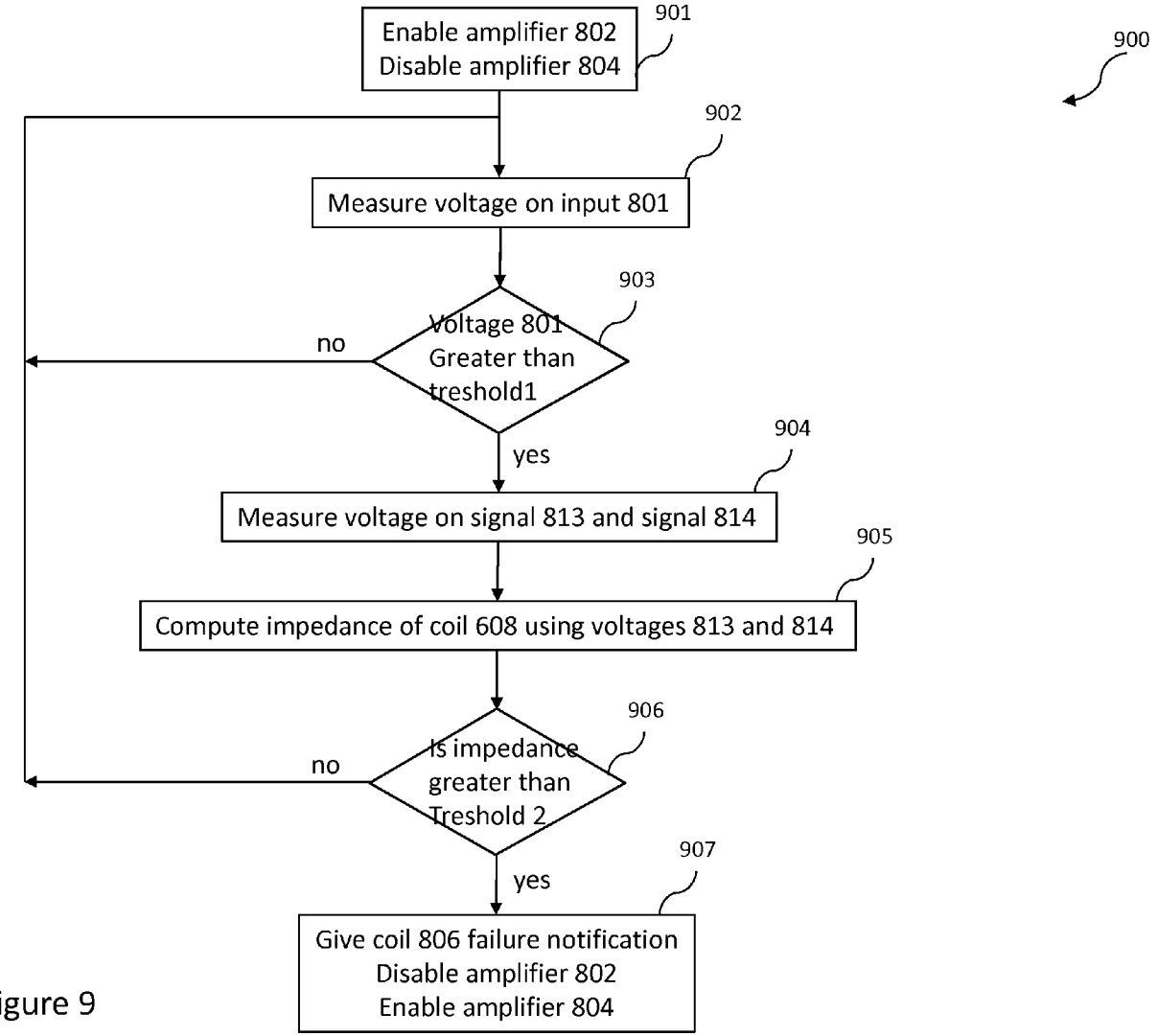
FIG. 9 shows a flow chart of a method according to one embodiment.

FIG. 8 shows one embodiment of a high reliability speaker system using continuous monitoring. Blocks 810, 811 and 818 may comprise electronic circuits that allow a low-cost micro-processor with slow analog inputs to measure the amplitude of small AC voltages accurately. Blocks 810, 811 and 818 may contain a simple amplifier and rectification circuit, a peak detector with reset capability or any other circuits well known in the art. FIG. 9 is a flowchart of a method according to one embodiment. According to one embodiment, this method may be carried out through software executed by the micro-controller 808. The micro-controller executes block 901 and enables amplifier 802 through signal 803, and disables amplifier 804 through signal 805. This enables the input signal 801 to drive voice coil 806. The micro-controller may be configured to execute block 902 and measure the voltage on input signal 801. This for example detects a beep or other signal of sufficient input strength to carry out a reliable measurement of the impedance of coil 806 as detailed below. Decision 903 compares the measured voltage on input signal 801 against a pre-determined threshold1. If the voltage does not exceed the treshold1, the signal is too weak to perform a reliable coil impedance measurement and the micro controller reverts to block 902. If the measured voltage on input 801 exceeds treshold1, the micro-controller goes on to measure the coil impedance. The micro-controller may execute block 904 to measure the AC voltages on signal 813 and signal 814. After measuring the voltages, the micro-controller may then execute block 905 and compute the coil impedance. This computation involves the value of resistor 809 and the AC voltages on signals 813 and 814. The impedance Z of coil 806 may be computed by the formula $Z=R_{809}*V_{814}/(V_{813}-V_{814})$. The micro controller may then proceed with block 906. In block 906 the measured impedance Z of coil 806 may be compared against a pre-determined treshold2. If the impedance Z is less than treshold2, the coil is determined to be intact, and the micro-controller resumes operation 902. If the impedance is greater than treshold2, coil 806 is determined to have failed, and the micro-controller proceeds to block 907. In block 907, the micro-controller notifies the environment that coil 806 has failed using signal or bus 817. The micro-controller may then disable amplifier 802 through signal 803 and may enable amplifier 804 through signal 805. The input signal 801 may now drive coil 807 and normal operation continues.

Many variations of the system in FIG. 8 are possible. For example, a more powerful micro-controller with fast analog to digital inputs may be used. In that case, circuits 810, 811 and 818 may be comprise a single capacitor and two resistors that pass the AC signal on and add a DC bias, so that the signal is in range of the Analog to Digital converters of micro-controller 808. According to another embodiment, a low cost micro-controller with slow A/D inputs may be used, and circuits 810, 811 and 818 may be more complex circuits that perform amplification of the AC signal, rectification and peak detection. According to one embodiment, a full impedance measurement may be omitted, in favor of a simple measurement of the current through resistor 809. If the input signal exceeds a threshold and the current through resistor 809 does not, then coil 806 may be considered to have failed. One embodiment does not measure impedance or current, but instead uses a microphone connected to the micro-controller input to replace steps 904, 905 and 906 by a measurement that determines if a sound of sufficient amplitude is generated, and determine the coil to have failed if such a sound is not detected. Yet another embodiment replaces the micro-controller by a simple logic design that performs the functional blocks shown in FIG. 9. Those skilled in the art to which this application relates will appreciate that there are many modifications, deletions and substitutions possible with respect to FIG. 8 and FIG. 9.

According to one embodiment for testing for coil failure in a system using amplifiers is to not use a current sensing resistor between the amplifier and speaker, but instead to measure the power supply current used by the amplifier using a current sensing resistor or other sensing mechanism. When the current is below a certain threshold for a given audio input level, the coil may be determined to have failed.

Yet another embodiment may comprise a signal provided by the amplifier itself. Some amplifiers provide a speaker fail output signal or a speaker fail status bit that may be accessed over a bus, which may be used to good advantage herein.

Figure 10:
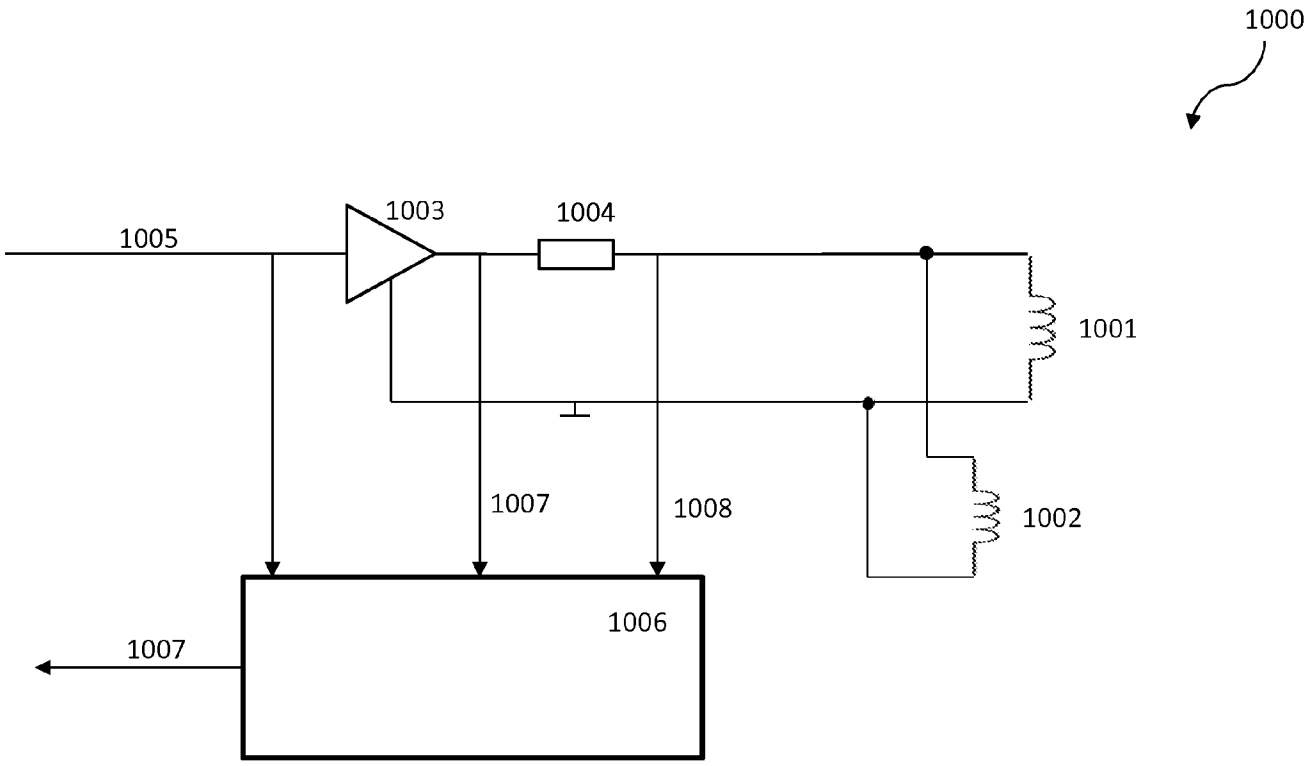
FIG. 10 shows one embodiment of a high reliability sound production system, using two voice coils with shared contacts, according to one embodiment.

FIG. 10 shows yet another embodiment of a high reliability speaker system according to one embodiment. In this embodiment, coils 1001 and 1002 share a common set of contacts. Input signal 1005 always drives both coils through amplifier 1003 and resistor 1004. Micro-controller 1006 may be configured to observe, for example, the input signal 1005, the amplifier output 1007 and the voltage on the coils 1008. Such observation may comprise direct sampling of the signals, or may comprise a small electronic circuit enabling the micro-controller to accurately measure small AC signals, such as circuits 810, 811 and 818 described above. Whenever there is an audio signal of sufficient amplitude, such as for example the periodic beep of a monitoring device, the micro controller measures the impedance of the speaker voice coils, by a computation involving voltage 1007, voltage 1008 and the value of resistor 1004. The micro-controller, for example, may be configured to measure the Root Mean Square (RMS) voltage on signal 1007 and signal 1008. The impedance of the speaker, Z, may then computed as $Z=R_{1004}*V_{1008}/(V_{1007}-V_{1008})$. The micro-controller may then determine that one of the coils has failed when the measured impedance Z exceeds a threshold. The micro-controller may be configured to notify the environment of coil failure through signal or bus 1007. According to one embodiment, the micro-controller may be configured to change the gain of amplifier 1003 to ensure that the volume of sounds remains the same, even though only one coil is now active.

The impedance may be computed using one of many different measurement methods. For example, a simple measurement of the minimum and maximum voltage of a set of samples of the voltage on signal 1007 and 1008 may be used to estimate the amplitude of the AC voltage on each signal and estimate the impedance of the coils. As another alternative a full measurement of impedance may be omitted and replaced by a simple current measurement using resistor 1004. If the input signal 1005 exceeds a threshold and the current through resistor 1004 does not exceed another threshold, one coil may be considered failed. Other methodologies are possible, as those of skill in this art may recognize.

Yet another embodiment of a high reliability speaker system may comprise two or more speakers instead of one speaker with two or more voice coils. In this embodiment, the two coils in FIGS. 3, 4, 5, 6, 7, 8 or FIG. 10 are instead replaced by two speakers. This creates a high reliability speaker system with similar capabilities. Advantageously, existing single coil speakers may be used, at the cost of a physically larger product.

The invention claimed is:

1. A system, comprising:

a loudspeaker comprising at least two voice coils and a bobbin, wherein the at least two voice coils are wrapped around the same bobbin;

a circuit comprising an input coupled to the at least two voice coils and configured to detect breakage of at least one of the voice coils; and a switching circuit configured to switch an input signal on the input to a remaining good voice coil.

2. The system of claim 1, wherein the circuit is further configured to generate a voice coil broken notification.

3. The system of claim 1, wherein the circuit is further configured to detect breakage of at least one of the voice coils by monitoring voice coil current.

4. The system of claim 1, wherein the circuit is further configured to determine breakage of at least one of the voice coils by monitoring voice coil impedance.

5. The system of claim 1, wherein the circuit is further configured to determine breakage of at least one of the voice coils by monitoring speaker sound output level with a microphone.

6. The system of claim 1, wherein the circuit further comprises an amplifier and is further configured to determine breakage of at least one of the voice coils by monitoring a supply current to the amplifier.

7. The system of claim 1, wherein the circuit further comprises at least one amplifier and wherein the switching circuit is configured to selectively enable and disable the at least one amplifier.

8. A system, comprising:

a loudspeaker comprising at least two voice coils and a bobbin, wherein the at least two voice coils are wrapped around the same bobbin and share a same two contacts;

a circuit configured to detect breakage of the voice coils;

and a voice coil broken notification output.

9. The system of claim 8, wherein the circuit is further configured to detect breakage of at least one of the voice coils by monitoring voice coil current.

10. The system of claim 8, wherein the circuit is further configured to detect breakage of the voice coils by measuring voice coil impedance.

11. A computer-implemented method, comprising:

receiving an input signal to a loudspeaker comprising at least two voice coils and a bobbin, wherein the at least two voice coils are wrapped around the bobbin;

detecting breakage of one of the at least two voice coils of the loudspeaker; and upon detecting breakage, switching the input signal to a remaining good voice coil.

12. A non-transitory machine-readable medium having data stored thereon representing sequences of instructions which, when executed by a computer, causes the computer to perform the steps of:

measuring an impedance of a number of coils connected in parallel, wherein the number of coils are wrapped around the same bobbin; and based on the measured impedance, providing a notification if one or more of the coils are broken.

13. A non-transitory machine-readable medium having data stored thereon representing sequences of instructions which, when executed by a computer, causes the computer to perform the steps of:

detecting breakage of one of a plurality of voice coils, wherein the plurality of voice coils are wrapped around the same bobbin; and upon detecting breakage of one of the plurality of voice coils, switching an input signal to a remaining good voice coil.

* * * * *